US005195901A

United States Patent [19]

Correnti

[11] Patent Number: 5,195,901

[45] Date of Patent: Mar. 23, 1993

[54] ELECTRICAL OUTLET SAFETY COVER

[75] Inventor: Giuseppe A. Correnti, Little Ferry, N.J.

[73] Assignee: G & G New Idea Corporation, Little Ferry, N.J.

[21] Appl. No.: 910,522

[22] Filed: Jul. 8, 1992

Related U.S. Application Data

[63] Continuation-in-part of Ser. No. 769,406, Oct. 1, 1991, abandoned.

[51] Int. Cl.[5] ..... H01R 13/44

[52] U.S. Cl. ..... 439/147; 174/67

[58] Field of Search ..... 439/135, 136, 142, 147, 439/144; 174/66, 67

[56] References Cited

U.S. PATENT DOCUMENTS

| | | | |
|---|---|---|---|
| 2,526,606 | 10/1950 | Gregg | 439/135 |
| 3,013,105 | 12/1961 | Craig | 439/135 |
| 3,656,083 | 4/1972 | Brook | 439/147 |
| 4,541,538 | 9/1985 | Swetnam | 174/67 |
| 4,603,932 | 8/1986 | Heverly | 439/147 |
| 4,874,906 | 10/1989 | Shotey | 174/67 |

*Primary Examiner*—Neil Abrams
*Attorney, Agent, or Firm*—Donald R. Heiner

[57] ABSTRACT

An electrical wall plug outlet enclosure and safety device wherein a face plate is detachably mounted to the wall over the electrical wall plug outlet and in turn a generally rectangular but tapered cover is detachably mounted to the face plate to prevent touching of an inserted electrical plug and to prevent the insertion of an object, especially a metal object, into the electrical outlet when a plug is not inserted. The cover further has openings at one end for passage of an electrical cord or cords attached at one end to an electrical plug and at its other end to an electrical appliance. The face plate has slots formed in or near its vertical edges for engagement with flanges formed on opposite sides of the box-like cover to detachably secure the box-like cover to the face plate. To detach or uncouple the cover from the face plate one finger of each hand presses or pulls up on finger holes formed on each longitudinal side of the cover while at the same time the thumb of each hand presses down on the top of the cover therefore causing the sides of the cover to flex outward and release the flanges from the slots and thereby exposing the electrical plug outlet. In the preferred embodiment the face plate has a rectangular frame attached to its front face and the flange engaging slots are formed in its vertical sides.

2 Claims, 4 Drawing Sheets

ELECTRICAL OUTLET SAFETY COVER

This application is a continuation in part of patent application Ser. No. 07/769,406 filed Oct. 1, 1991 and now abandoned.

CROSS REFERENCE TO RELATED APPLICATIONS

Applicant has a co-pend application Ser. No. 07/906,488 which is a continuation in part of Patent Application Ser. No. 7/769,407 filed Oct. 1, 1992 and now abandoned for the same general subject matter as the instant invention.

BACKGROUND OF THE INVENTION

1. Field of the Invention The present invention generally relates to that field of technology pertaining to devices for covering an electrical wall outlet receptacle and more specifically, to a combination of a detachably mounted face plate adopted to be secured to a wall and over an electrical receptacle and a box-like cover detachably connected to the face plate by means of flanges formed on opposite sides of the box-like cover engaging corresponding slots formed in the face plate. The box-like cover is essentially of rectangular shape with one open end which engages the face plate. The end or side of the cover, opposite the open end, is closed and the cover tapers from the open end to the closed end making it difficult for anyone, especially a child, to grasp and pull on the box-like cover in an attempt to disengage it from the face plate.

Two embodiments of the face plate are disclosed with another embodiment disclosing one of the two face plates with a boarder plate which is not mounted to an electrical receptacle but which merely is disposed on the wall under the face plate for decorative purposes. In the preferred embodiment a rectangular frame is attached to the front face of the face plate and slots are formed in the frame for engaging the flanges of the box-like cover.

Openings are provided in the box-like cover through which electrical cords pass when an electrical appliance is plugged into the electrical outlet and the cover is pressed over and into engagement with the face plate.

Electrical wall outlets present several significant dangers to children and adults alike. Electrical cords tend to become worn or frayed where they enter an electrical plug; an electrical plug may become partially disengaged from an outlet thereby exposing the prongs of the plug; or, if no appliance is plugged into the electrical outlet, there is the danger of someone, especially a child, inserting a metal object into the outlet and receiving a shock.

Therefore, a need exists for a safety device which prevents against these dangers.

2. Description of the Prior Act

In applicant's co-pending application the examiner has cited the following references as examples of other devices which provide protection against the inherent dangers of electrical wall outlets; Swetnam U.S. Pat. No. 4,541,538; Brook U.S. Pat. No. 3,656,083; Gregg U.S. Pat. No. 2,526,606; and Heverly U.S. Pat. No. 4,603,932.

The Swetnam U.S. Pat. No. 4,541,538 relates to a wiring device cover having detents projecting from side walls which cooperate with notches in a face plate of a wiring device. Such a device can not be employed with a face plate of a standard electrical wall outlet. Further, the shape of the cover of the instant invention is substantially different and has flanges engaging slots formed in a face plate which is secured to an electrical wall plug outlet.

Brook U.S. Pat. No. 3,656,083 depends for its proper function on a generally circular shaped cover having lips formed interiorly thereof which engage projections on a part of flanges configured to arcuate portions of electrical outlet apertures which are of double truncated circular shape. There is no similarity between the protective cover of the instant invention and the cover of Brook.

H.G. Gregg U.S. Pat. No. 2,526,606 discloses a face plate or base plate comprising a plurality of outwardly extending bars and an elongated retaining bar or extension which are absent from the face plate of the instant invention. Further, the hood of H. J. Gregg is of substantially different configuration than the cover of the instant invention.

Heverly U.S. Pat. No. 4,603,932 requires protruding tabs on the outside of a box-like structure which cooperate with cutouts formed in a frame to join the two pieces when the box-like structure slips within the frame.

Applicant has also been made aware of the patents cited by the examiner against his application 07/769,407 all of which have been discussed by applicant in a co-pending application, Ser. No. 07/906,488 co-pending to application 07/769,407.

SUMMARY OF THE INVENTION

According to the present invention a face plate having one or more openings therethrough for receiving a standard electrical plug is attached by any well known means, such as a screw or other fastening device, to a wall mounted electrical plug receptacle. The face plate has slots formed in its vertical edges for receiving flanges formed integral with the long sides of a generally rectangular shaped cover having one open side whereby the face plate and cover become detachably interlocked. The cover further has openings at either end for passage of electrical cords connected at one end to an electrical plug and at its other end to an electrical appliance.

The cover is of box-like generally rectangular shape or perhaps better described as a truncated pyramid but with a rectangular rather than a square shaped base.

Disposed on the two long sides of the box-like cover and preferably formed integral therewith and turned inward toward the center of the box-like cover are flanges for slidably engaging the slots formed in the vertical edges of the face plate.

The taper of the cover makes it extremely difficult to grasp and pull apart from the face plate thus making it necessary to disengage the flanges from the slots by means of fingers grasping finger holes formed in the long sides of the box-like cover, adjacent the flanges, and pulling outward while at the same time the thumbs of each hand press downwardly on the top of the cover causing the box-like cover to flex outwardly causing the flanges to be disengaged from the slots of the face plate.

It is therefore an object of the present invention to provide a protective cover for an electrical wall outlet.

It is another object of the invention to provide an improved protective cover for an electrical wall outlet having a protective cover engaging a face plate which in turn is mounted on an electrical plug receptacle.

It is a further object of the invention to provide an improved protective cover for an electrical wall outlet wherein a face plate has slots formed in its vertical edges for engagement with flanges formed on the cover member.

It is yet another object of the invention to provide an improved protective cover for an electrical wall outlet wherein the cover member is a truncated pyramid but with a rectangular rather than a square shaped base making it difficult to grasp and pull apart from a face plate.

These and other objects, features and advantages of the invention shall become apparent from the following detailed description of a preferred embodiment thereof when taken in conjunction with the drawings wherein like reference characters refer to corresponding parts in the several views.

DETAILED DESCRIPTION OF THE PREFERRED EMBODIMENT

An electrical wall plug outlet enclosure and safety device according to a preferred embodiment of the invention will now be described with initial reference to FIGS. 1-6 of the drawings. Two other slightly different embodiments will then be described with reference to FIGS. 7-12 and 13-18.

Figure 4:
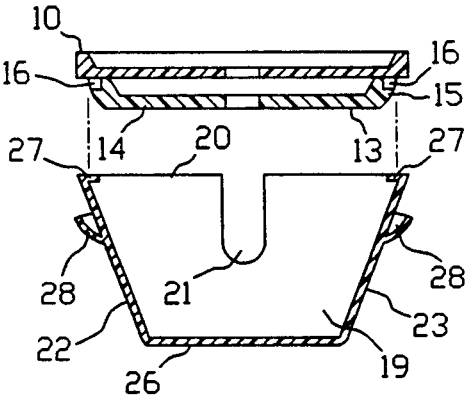
FIG. 4 is an exploded sectional view taken on line 4—4 of FIG. 1 and 5—5 of FIG. 6.
Figure 5:
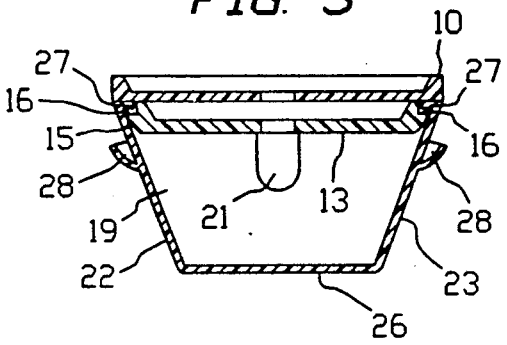
Figure 6:
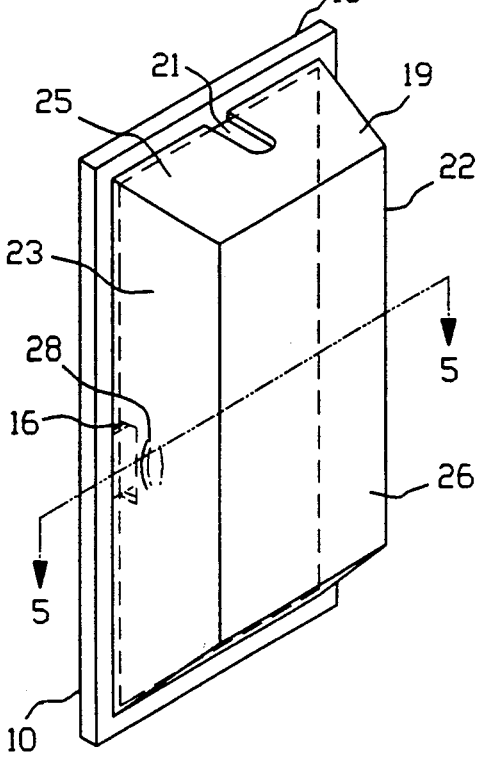

A face plate 10 for mounting on to an electrical wall plug outlet, not shown, has electrical plug receiving openings 11 formed thenthrough for receiving an FIG. 5 is an assembled cross sectional view, taken on line 5—5 of FIG. 6, similar to FIG. 4, but assembled rather than exploded.

Figure 1:
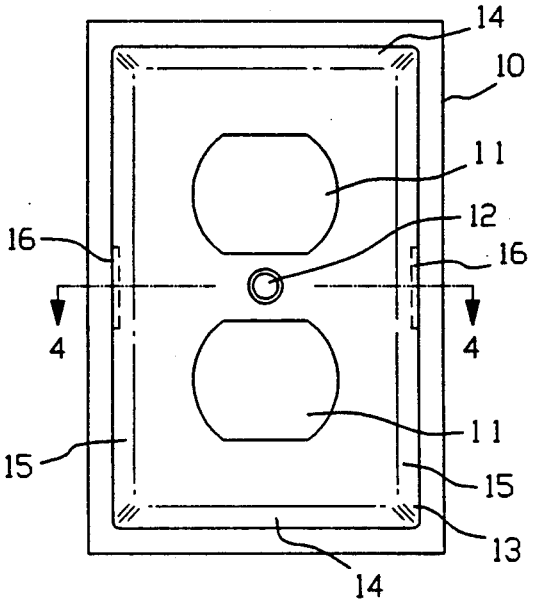
FIG. 1 is a front view of one of the face plates of the invention showing the slots, openings for receiving an electrical plug, rectangular frame and opening for receiving a fastener for attaching the face plate to an electrical wall plug receptacle not shown.
Figure 2:
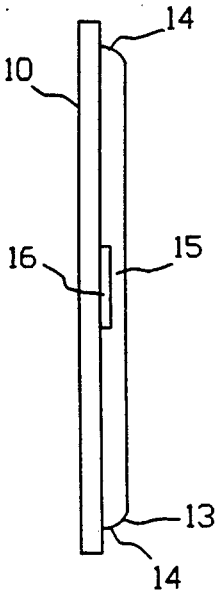
FIG. 2 is an end view of the face plate of FIG. 1 looking into the left end.
Figure 3:
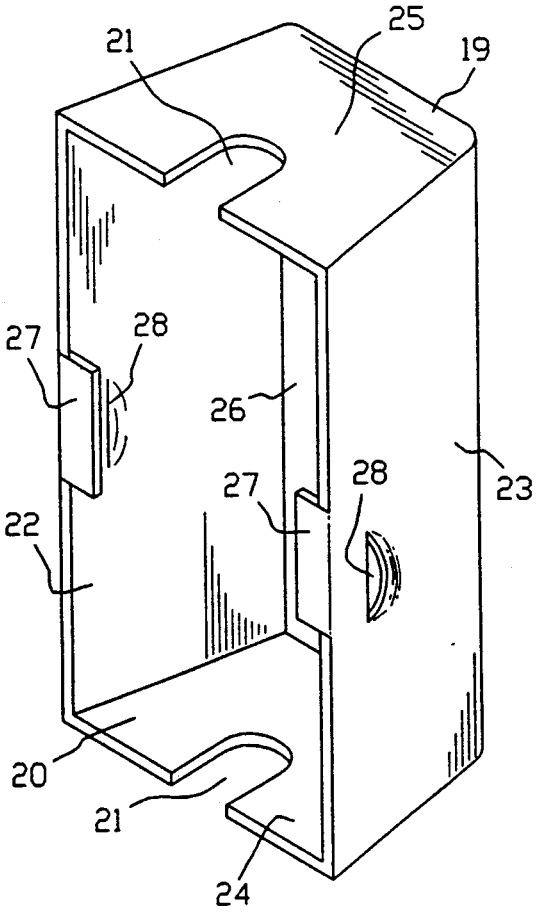
FIG. 3 is a perspective view of the box-like cover of the invention showing the flanges for engagement with the slots formed in the face plate, the finger holes, and openings for electrical cords.

FIG. 6 is a view showing the face plate of FIG. 1 and the box-like cover of FIG. 3 assembled.

Figure 7:
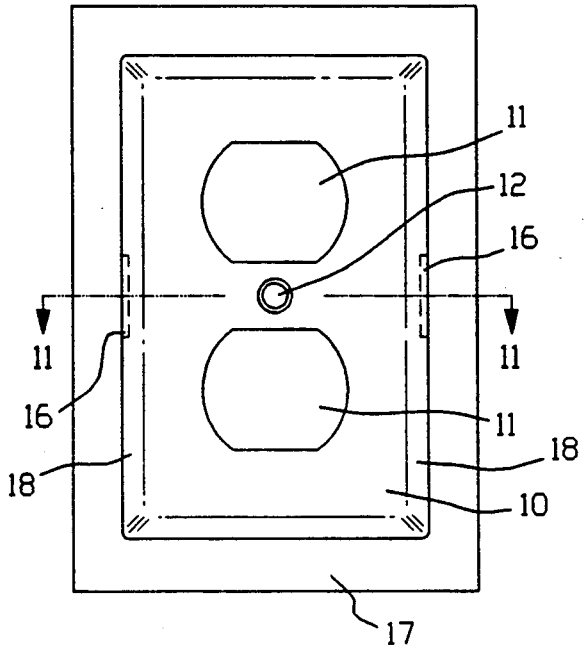

FIG. 7 is a front view of a face plate similar to FIG. 1 but having a wide boarder for covering a wall.

Figure 8:
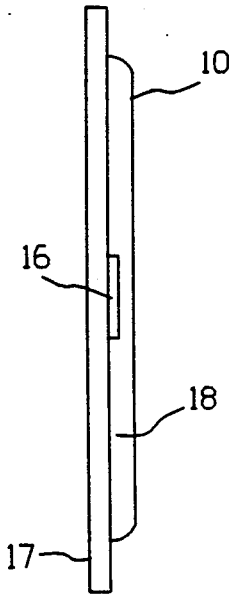

FIG. 8 is a side view of FIG. 7 looking into the left end.

Figure 9:
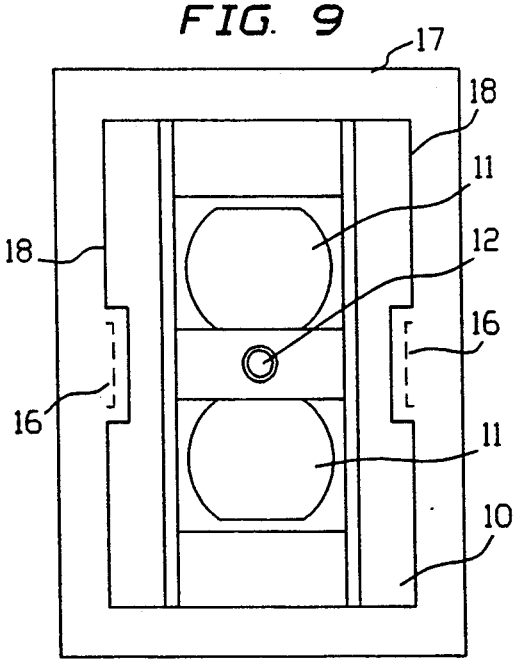

FIG. 9 is a rear view of FIG. 7.

Figure 10:
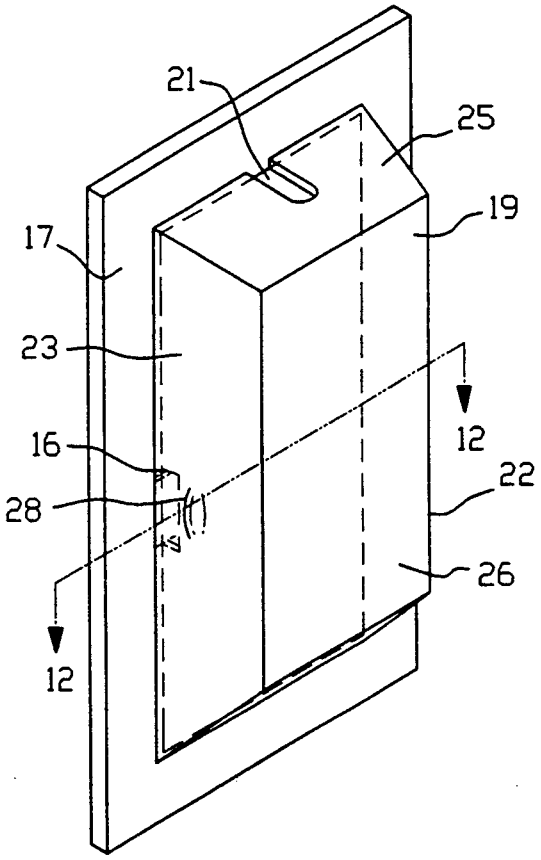
Figure 18:
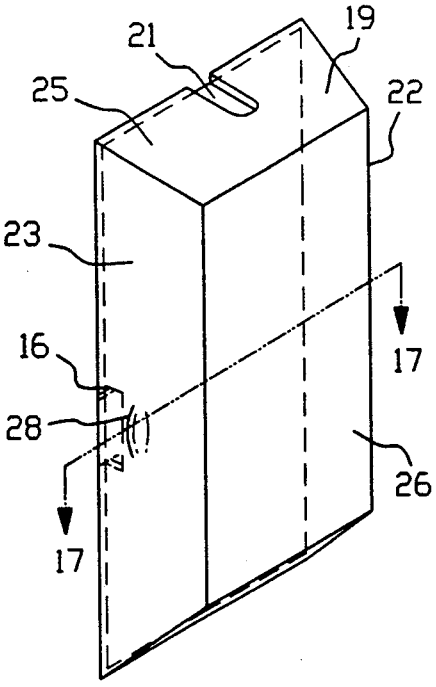
FIG. 18 is a view similar to FIGS. 6 and 10 but with the face plate of FIG. 13.

FIG. 10 is a view similar to FIG. 6 but with the face plate and boarder of FIG. 7.

Figure 11:
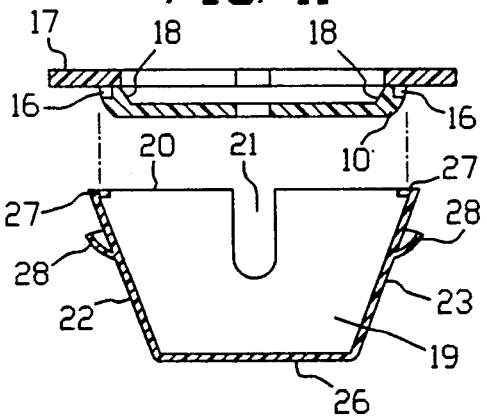
Figure 12:
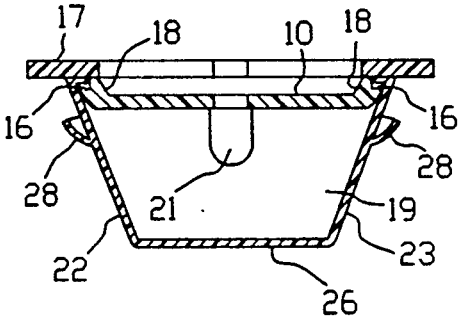

FIG. 11 is an exploded cross sectional view taken on line 11—11 of FIG. 7 and 12—12 of FIG. 10.

FIG. 12 is an assembled cross-sectional view, taken on line 12—12 of FIG. 10 similar to FIG. 11 but assembled rather than exploded.

Figure 13:
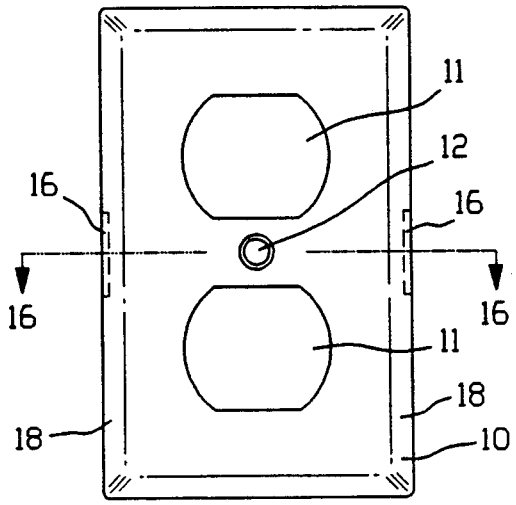
Figure 14:
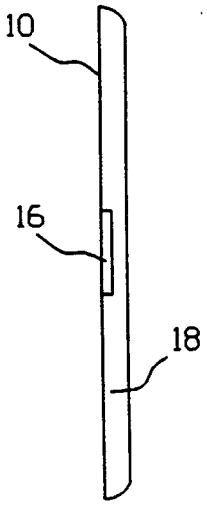
FIG. 14 is an end view of FIG. 13 looking into the left end.
Figure 15:
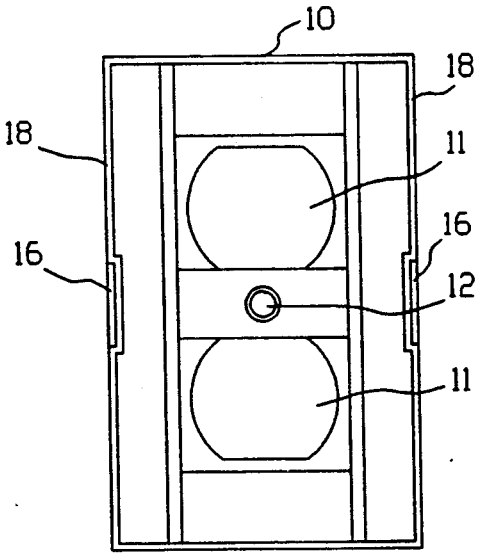
FIG. 15 is a rear view of the face plate of FIG. 13.
Figure 16:
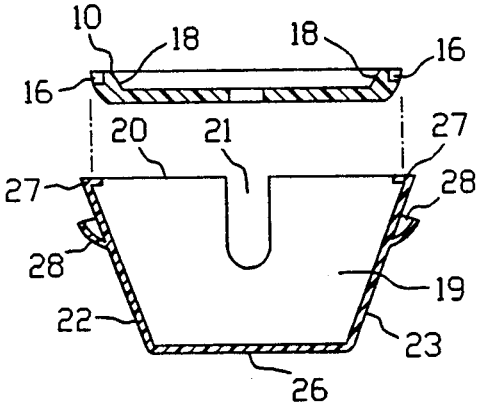
FIG. 16 is an exploded cross-sectional view taken on line 16—16 of FIG. 13 and line 17—17 of FIG. 18.
Figure 17:
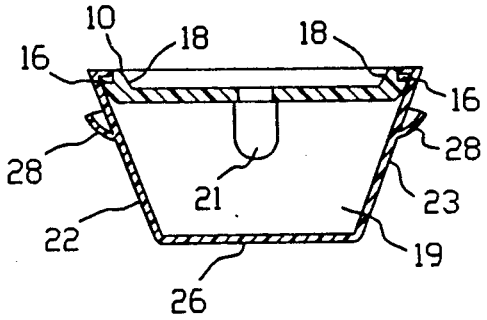
FIG. 17 is an assembled cross-sectional view taken on line 17—17 of FIG. 18 similar to FIG. 16 but assembled rather than exploded.

FIG. 13 is a front view of a face plate similar to FIGS. 1 and 7 but without the rectangular frame boarder. electrical plug, not shown. An electrical cord is attached at one end to the electrical plug and at its other end to an electrical appliance all of which are not shown. A fastener 12, such as a screw, is located at the approximate mid-point of face plate 10 for securing face plate 10 to an electrical wall plug outlet.

Mounted on the front surface of the face plate 10 of FIG. 1 is a rectangular frame 13 having horizontal sides 14 and vertical sides 15. Slots 16 are formed in each of the vertical sides 15 for engaging flanges formed on a box-like cover whereby the cover is secured to the face plate to cover the electrical wall plug outlet all as will be more fully described below.

The face plate 10 of FIGS. 7-12 does not have the rectangular frame 13 of FIGS. 1-6 but has a boarder plate 17 which is disposed on the wall, over the wall plug, outlet and under face plate 10. In the face plate of this embodiment slots 16 are formed in each of the vertical sides 18 of face plate 10 for the same purpose previously described in connection with the face plate 10 of FIGS. 1-6.

The face plate 10 of FIGS. 13-17 has neither the rectangular frame 13 nor the boarder plate 17 of FIGS. 1 and 7 and the slots 16 as formed in each of the vertical sides 18 of face plate 10 as described in connection with the face plate of FIGS. 7-12. The face plate of FIG. 13 is identical to the face plate of FIG. 7.

Turning now to FIGS. 3, 6, 10, and 18 there is shown a generally rectangular shaped box-like cover 19 having one open end 20 and openings 21 for receiving an electrical cord which is attached at one end to an electrical plug and at its other end to an electrical appliance and all of which are not shown. This box-like cover 19 is a truncated pyramid with a rectangular base and four adjacent sides 22, 23, 24 and 25 which taper toward the side 26 opposite the open end 20. Formed integrally with sides 22 and 23 of box-like cover 10 are flanges 27 which project inwardly toward the open end 20 thereof. These flanges 27 engage the slots 16 formed in the face plate 10 or rectangular frame 13 when box-like cover 19 is positioned with its open end 20 over face plate 10, slots 16 aligned under flanges 27, and the box-like cover is pressed against face plate 10. By reason of the flanges engaging the slots the box-like cover is securely fastened to the face plate to protect against the electrical hazards previously discussed.

Adjacent to flanges 27, on the sides 22 and 23 of box-like cover 19, are finger holes 28. When it is desired to disengage the box-like cover 19 from face plate 10 one finger of each hand grasps one of said finger holes 28 while at the same time the thumb of each hand presses downwardly on the top 26 of box-like cover 19 causing it to flex outwardly causing the flanges 27 to be disengaged from slots 16 and thereby disengage the cover from the face plate and exposing the electrical wall plug outlet.

It is readily seen that the slots may be formed in the horizontal rather than the vertical sides of the face plate or rectangular frame and that the flanges of the box-like cover may be disposed on the shorter sides 24 and 25 of the cover and the finger holes would then also be disposed on sides 24 and 25 adjacent the flanges. In this embodiment the electrical cord receiving openings 21 of box-like cover 19 would be formed in the longer sides 22 and 23.

Though the invention has been described and illustrated with reference to a preferred embodiment thereof, those skilled in the art will appreciate that various changes and modifications in shape, size, composition and arrangement of parts may be resorted to without departing from the spirit of the invention or scope of the subjoined claims.

What is claimed is:

1. An electrical wall plug outlet enclosure and safety device comprising:

(a) a generally rectangular face plate having at least one electrical plug receiving opening detachably mounted to an electrical wall plug outlet for detachably receiving a box-like cover;

(b) a plurality of slots formed in vertical sides of said generally rectangular face plate;

(c) a generally rectangular shaped box-like cover having one open end for positioning over said face plate wherein said box-like cover is a truncated pyramid wherein the open end is rectangular and the four sides adjacent the open end taper toward the side opposite the open end and wherein at least one side of said box-like cover has an opening for receiving an electrical cord which si attached at one end to an electrical plug and at its other end to an electrical appliance and wherein finger holes are formed in the two longer sides of said box-like cover adjacent said flanges whereby when it is desired to disengage said box-like cover from said face plate one finger of each band grasps one of said finger hole while at the same time the thumb of each hand presses downwardly on the top of said box-like cover causing said flanges to be disengaged from said slots of said face plate; and (d) a plurality of flanges formed on the longer sides of said box-like cover adjacent the open end whereby when said box-like cover is positioned over and pressured against said face plate said flanges engage said slots holding said box-like cover in locking engagement with said face plate.

2. An electrical wall plug outlet enclosure and safety device comprising:

(a) a generally rectangular face plate having at least one electrical plug receiving opening detachably mounted to an electrical wall plug outlet for detachably receiving a box-like cover;

(b) a rectangular frame mounted on the front face of said face plate;

(c) a plurality of slots formed in the vertical sides of said rectangular frame;

(d) a generally rectangular shaped box-like cover having one open end for positioning over said face plate wherein said box-like cover is a truncated pyramid wherein the open end is rectangular and the four sides adjacent the open end taper toward the side opposite the open end and wherein at least one side of said box-like cover has an opening for receiving an electrical cord which is attached at one end to an electrical plug and at its other end to an electrical appliance and wherein finger holes are formed in the two longer sides of said box-like cover adjacent said flanges whereby when it is desired to disengage said box-like cover from said face plate one finger of each hand grasps one of said finger holes while at the same time the thumb of each hand presses downwardly on the top of said box-like cover causing said flanges to be disengaged from said slots of said face plate; and (e) a plurality of flanges formed on the longer sides of said box-like cover adjacent the open end whereby when said box-like over is positioned over and pressed against said face plate said flanges engage said slots holding said box-like cover in locking engagement with said face plate.

* * * * *

UNITED STATES PATENT AND TRADEMARK OFFICE

CERTIFICATE OF CORRECTION

PATENT NO. : 5,195,901

DATED : March 23, 1993

INVENTOR(S) : Giuseppe A. Correnti

It is certified that error appears in the above-indentified patent and that said Letters Patent is hereby corrected as shown below:

Column 3, lines 33-54, the following text should be deleted in its entirety, and inserted in column 4, line 6, between "border and electrical".

FIG. 5 is an assembled cross sectional view, taken on line 5—5 of FIG. 6, similar to FIG. 4, but assembled rather than exploded.

FIG. 6 is a view showing the face plate of FIG. 1 and the box-like cover of FIG. 3 assembled.

FIG. 7 is a front view of a face plate similar to FIG. 1 but having a wide boarder for covering a wall.

FIG. 8 is a side view of FIG. 7 looking into the left end.

FIG. 9 is a rear view of FIG. 7.

FIG. 10 is a view similar to FIG. 6 but with the face plate and boarder of FIG. 7.

FIG. 11 is an exploded cross sectional view taken on line 11—11 of FIG. 7 and 12—12 of FIG. 10.

FIG. 12 is an assembled cross-sectional view, taken on line 12—12 of FIG. 10 similar to FIG. 11 but assembled rather than exploded.

FIG. 13 is a front view of a face plate similar to FIGS. 1 and 7 but without the rectangular frame boarder.

UNITED STATES PATENT AND TRADEMARK OFFICE

CERTIFICATE OF CORRECTION

PATENT NO. : 5,195,901

DATED : March 23, 1993

INVENTOR(S) : Giuseppe A. Correnti

It is certified that error appears in the above-indentified patent and that said Letters Patent is hereby corrected as shown below:

Column 5, line 26, "si" should read --is--.

line 32, "band" should read --hand--.

Signed and Sealed this

Twenty-sixth Day of April, 1994

Bruce Lehman

*Attest:*

BRUCE LEHMAN

*Attesting Officer*

*Commissioner of Patents and Trademarks*